US011413678B2

(12) United States Patent
Williams et al.

(10) Patent No.: US 11,413,678 B2
(45) Date of Patent: Aug. 16, 2022

(54) TRANSFER BELT ASSEMBLY FOR A SIX-OUT CONVERSION SYSTEM

(71) Applicant: Stolle Machinery Company, LLC, Centennial, CO (US)

(72) Inventors: Greg Scott Williams, Wapakoneta, OH (US); Robert Joseph Will, Maria Stein, OH (US); Michael Richard Soliday, Piqua, OH (US)

(73) Assignee: Stolk Machinery Company, LLC, Centennial, CO (US)

( * ) Notice: Subject to any disclaimer, the term of this patent is extended or adjusted under 35 U.S.C. 154(b) by 196 days.

(21) Appl. No.: 16/244,203

(22) Filed: Jan. 10, 2019

(65) Prior Publication Data

US 2020/0222966 A1 Jul. 16, 2020

(51) Int. Cl.
*B21D 43/12* (2006.01)
*B21D 51/38* (2006.01)

(52) U.S. Cl.
CPC ..... *B21D 43/12* (2013.01); *B21D 51/383* (2013.01)

(58) Field of Classification Search
CPC ..... B21D 51/26; B21D 51/38; B21D 51/383; B21D 43/12; B21D 51/44; B21D 51/446; B65G 45/16; B65G 43/003
USPC ..... 413/3, 56; 198/867.11, 867.12, 803.13, 198/803.14
See application file for complete search history.

(56) References Cited

U.S. PATENT DOCUMENTS

| | | | | | |
|---|---|---|---|---|---|
| 4,213,324 | A * | 7/1980 | Kelley | B21D 51/383 | 72/405.02 |
| 4,546,873 | A * | 10/1985 | Debenham | B21D 43/023 | 198/836.2 |
| 4,627,265 | A | 12/1986 | Bulso, Jr. et al. | | |
| 4,627,625 | A * | 12/1986 | Bulso | B21D 51/383 | |
| 4,640,116 | A | 2/1987 | Brown | | |
| 4,799,846 | A * | 1/1989 | Wissman | B21D 51/383 | 198/803.15 |
| 4,822,232 | A * | 4/1989 | Gantz | B21D 43/20 | 198/803.15 |
| 5,182,934 | A * | 2/1993 | Herdzina | B21D 51/383 | 413/56 |
| 5,511,920 | A | 4/1996 | Artrip | | |
| 9,321,097 | B2 * | 4/2016 | Butcher | B21D 51/44 | |
| 2003/0015507 | A1 * | 1/2003 | Miller | B23K 26/082 | 219/121.68 |
| 2003/0053890 | A1 * | 3/2003 | Turner | B21D 51/383 | 413/14 |
| 2007/0166131 | A1 * | 7/2007 | Cook | B21D 51/383 | 413/52 |

(Continued)

OTHER PUBLICATIONS

Slac Precision Equipment Ltd. HEXADTM Conversion System, Company News, http://slac.com.cn/en/newsshow.asp?id=6, Sep. 14, 2018, 3 pages.

(Continued)

*Primary Examiner* — Adam J Eiseman
*Assistant Examiner* — Bobby Yeonjin Kim
(74) *Attorney, Agent, or Firm* — Eckert Seamans Cherin & Mellott LLC

(57) ABSTRACT

A transfer belt assembly includes a plurality of transfer belts. The transfer belt assembly is structured to move any of an increased number of shells, a very increased number of shells, or an extremely increased number of shells through said conversion press.

5 Claims, 4 Drawing Sheets

(56) References Cited

U.S. PATENT DOCUMENTS

| | | | | |
|---|---|---|---|---|
| 2007/0283738 | A1 | 12/2007 | Turnbull et al. | |
| 2008/0267736 | A1* | 10/2008 | Artrip | B21D 51/383 413/66 |
| 2014/0318205 | A1* | 10/2014 | Mccarty | B21D 43/18 72/361 |
| 2016/0030996 | A1* | 2/2016 | Butcher | B21D 51/38 413/66 |
| 2018/0029104 | A1 | 2/2018 | Hafner | |

OTHER PUBLICATIONS

Slac Hexad Conversion System—Slac Products and Solutions, http://dev.slacdayton.com/Products-And-Solutions/post/slac-hexad-conversion-system, Sep. 19, 2018, 3 pages.
Stolle Machinery Company, LLC, PCT/US19/65974 International Search Report and Written Opinion, dated Feb. 19, 2020, 15 pages.

* cited by examiner

TRANSFER BELT ASSEMBLY FOR A SIX-OUT CONVERSION SYSTEM

BACKGROUND OF THE INVENTION

Field of the Invention

The disclosed and claimed concept relates to a conversion system and, more specifically, to a transfer belt assembly for a conversion press structured to produce six can ends per cycle.

Background Information

Metallic containers (e.g., cans) for holding products such as, for example, food and beverages, are typically provided with an easy open can end on which a pull tab is attached (e.g., without limitation, riveted) to a tear strip or severable panel. The severable panel is defined by a scoreline in the exterior surface (e.g., public side) of the can end. The pull tab is structured to be lifted and/or pulled to sever the scoreline and deflect and/or remove the severable panel, thereby creating an opening for dispensing the contents of the can. Hereinafter, a twelve ounce beverage can will be used as an example. It is understood, however, that the disclosed and claimed concept is not limited to twelve ounce beverage cans.

As used herein, a "can end" consists of a "shell" and "tab." As used herein, a "shell" is the portion of a "can end" that is structured to be, and is, coupled to a "can body" wherein the "can body" defines a generally enclosed space. The "tab" is the construct coupled to the shell and which is structured to be, and is, lifted and/or pivoted relative to the shell at a location adjacent a scoreline whereby the scoreline is severed creating an opening for dispensing the contents of the can. As such, a "can end" is, essentially, a "shell" with a "tab" attached and the terms "can end" and "shell" are, as used herein, interchangeable.

In an exemplary embodiment, the shell and the tab are made in separate presses. The shell is created by cutting out and forming a blank from a coil of sheet metal product (e.g., without limitation, sheet aluminum: sheet steel). For the exemplary beverage can shell, the blank is generally planar and generally circular. For such a beverage can shell, the shell press forms an annular countersink adjacent the periphery of the blank as well as a seaming panel that is structured to be, and is, coupled to a can body. In one exemplary embodiment, additional constructs associated with a beverage can shell such as, but not limited to, a scoreline defining a deflectable tear panel, are also formed in the shell press. In another exemplary embodiment, the additional constructs are formed in the conversion press, discussed below. Further, the tabs are typically formed in the conversion press immediately prior to staking, i.e., coupling, the tabs to the shells.

Generally, the shell press, and the conversion press, include a ram press and a tooling assembly with a movable upper tooling and a stationary lower tooling. That is, as used herein, the "ram press" is an assembly that is being identified as a component of the conversion press as opposed to the other way around. This is because a ram press is typically sold as a complete unit to which the tooling and other components are added so as to form the shell/conversion press. There is a significant number of ram presses in use and newer ram presses are, generally, made with the same specifications, characteristics, and/or dimensions. Such ram presses include, but are not limited to, the Minster EC-H44-QL made by Nidec Minster Corporation, 240 West Fifth Street, P.O. Box 120, Minster, Ohio 45865-0120, U.S.A. As used herein, such ram presses are "legacy" ram presses. That is, a "legacy" ram press is a ram press having the specifications, characteristics, and/or dimensions of existing ram presses. It is understood that a ram press that is made with specifications, characteristics, and/or dimensions specifically to accommodate six single shell lanes, as defined below, is not a "legacy" ram press.

As is known, a ram press includes an elongated ram body through which force is transferred. That is, as used herein, the ram press has a "line of action" (the line through which force is applied) that is substantially aligned with the longitudinal axis of the ram body. Thus, the ram press, essentially, applies a load at a single location disposed at the end of the ram body. The upper and lower toolings include a number of mounting devices to which a plurality of dies are coupled. These mounting devices are hereinafter identified as a "die shoe." That is, there is a number of upper die shoes and a number of lower die shoes. The upper and lower shoes support a number of associated dies, as discussed below. The upper tooling moves between a spaced, upper position, wherein the upper tooling, and therefore the upper die shoe, is spaced from the lower tooling and the lower die shoe, and a lower/forming, second position, wherein the tooling dies contact and form the blanks. The reciprocal motion wherein the upper tooling moves from the first position to the second position and then returns to the first position is, as used herein, a "cycle."

In the known art, each die shoe supports a "single lane" shell die set or a single "multiple lane" shell die set. As used herein, a "die set" means a plurality of dies that are structured to be, and are, disposed in series wherein each die forms a portion of the shell, or tab, when the upper tooling is in the second position. As used herein, each "die set" inherently includes "upper dies" and "lower dies." Thus, following an introduction of a "die set" it is understood that there are inherently "die set upper dies" and "die set lower dies." Thus, as used herein, following an introduction of a "die set," the "die set upper dies" and "die set lower dies" do not have to be specifically introduced as they are inherently introduced as part of the "die set." As used herein, a "lane" is a path defined by a die set through which a shell moves as it is being formed. Thus, in a conversion press there is one "die set" for the tabs and a plurality of "die sets" for the shells. Further, the shell die sets are substantially similar to each other. That is, in an exemplary embodiment, each die set includes substantially similar dies that are disposed in the same sequence. Thus, as the blanks/shells move through the conversion press, each "lane" forms one shell into a substantially similar "can end."

Each shell die set is structured to and does, perform a number of forming operations on the blank/shell. In an exemplary embodiment, an individual die performs one forming operation on the blank/shell. It is understood that each upper die has an associated lower die whereby the upper die and lower die operate cooperatively to accomplish the forming operation. In this configuration, each die is identified as a "station." As used herein, a "station" is a location on the tooling and/or the lane that includes a forming die, or, which is a location for a "null" station. A "null" station is a location without a die or wherein no forming operations occur.

Further, the blanks are "indexed" through the tooling assembly. As used herein, to "index" means that the blank or a strip of metal is moved intermittently through the tooling assembly a predetermined/set distance during each cycle of the ram press/tooling assembly. As is generally known, as the upper tooling is moving from the second position to the first position, the blanks/shells are moving between stations. In some presses, the blanks/shells are also moving as the upper tooling moves toward the second position. Before the upper tooling moves fully into the forming, second position, and while the upper tooling is in the forming, second position, the blanks/shells stop moving at a "station." Thus, as the blanks move through the tooling assembly, the blanks/shells are progressively formed into shells.

The tabs are twined in a similar manner but are generally formed directly in a sheet of metal. That is, the tabs are not initially cut into separate blanks that are individually formed. Instead, tabs are produced by feeding in a continuous sheet of metal through a tab die and the tabs are substantially formed while coupled to the sheet. The tab die set forms one row of tabs in the strip for each shell lane. That is, if there are three shell lanes, the tab die forms three rows of tabs. As used herein, a "row" of tabs is a series of tabs extending along a line generally parallel to the longitudinal axis of the strip of material from which the tabs are found. The final formation step typically couples the tab to a shell while cutting the tab from the sheet. In an exemplary embodiment, the tab tooling assembly is directly adjacent and/or is part of the conversion press.

The shells, and in some embodiments the tabs, are conveyed to a conversion press. As used herein, a "conversion press" is an assembly including a ram press and number of die assemblies or die sets and which is structured to couple a tab to a shell thereby creating a can end. The number of forming operations performed on the shell by the shell press affects the number of forming operations performed on the shell by the conversion press. That is, either the shell press or the conversion press is, or can be, structured to perform certain operations such as, but not limited to, creating a score for a tear panel. In an exemplary embodiment, the conversion press stations form the paneling, score and integrated rivet on the shell. The rivet on the shell is the element/formation to which the tab is coupled. It is, however, understood that in another embodiment, the rivet is formed in the shell press.

Thus, in general, at the conversion press, the blank/shell is fed onto a transfer belt which indexes through an elongated, die set defining a number of lanes. It is understood that each shell passes through a single lane. That is, for example, a die shoe that supports two die lanes processes two sets of shells at the same time. Stated alternately, a die shoe that supports a single die set forms a single set of shells into can ends in a single lane. Conversely, tooling that supports multiple die sets wherein each die set defines a lane form multiple sets of shells into can ends even though each lane only forms one set of shells into can ends.

At the same time the shells are moving through the conversion press, the tabs are also being formed, either in a press adjacent the conversion press or in the conversion press, and are moved generally perpendicular to the direction of motion of the shells. Stated alternately, the longitudinal axes of the tab die rows are disposed generally perpendicular to the longitudinal axes of the shell dies lanes.

At, or near, the final tool station, the tab is coupled to the shell thereby creating the can end. As before, each tool station of the conversion press includes an upper tool die, which is structured to be advanced towards a lower tool die upon actuation of a ram press. The shell is received between the upper tooling and the lower tooling. Alternatively stated, the shell is received between the upper and lower tool assemblies. The upper tool assembly is structured to reciprocate between an upper position, spaced from the lower tool assembly, and a lower position, adjacent the lower tool assembly. Thus, the upper tool die engages the shell when the upper tool assembly is in the second position and the upper and/or lower tool die(s), respectively, act upon the public, outer side and/or the product side (e.g., interior side, which faces the can body) of the shell, in order to perform a number of the aforementioned conversion operations.

Further, in an exemplary embodiment, a downstacker feeds individual shells onto a transfer belt having cavities or recesses sized to accommodate a single shell. That is, a transfer belt includes a number of "columns" of recesses. Thus, as used herein, a "column" of recesses means a series of recesses wherein the center of each recess in the "column" is disposed substantially along a line extending substantially parallel to the longitudinal axis of the transfer belt. The "rows" of tabs move generally perpendicular to the "columns" of shells.

In use, a shell is deposited into each recess and the transfer belt is indexed through a lane. The transfer belt is made of an elastic material such as, but not limited to, rubber. Typically, there is one transfer belt for each die set. In a configuration with two tooling assemblies defining four lanes, there would be two transfer belts each with two columns. In this configuration, each transfer belt column is associated with one lane.

For a two lane die set, the transfer belt for each die set included adjacent sets of recesses wherein one set of recesses passed through each lane. Due to limitations relating to the resiliency of the transfer belt it is desirable to limit the width of the transfer belt. Generally, a transfer belt accommodates two columns of recesses. That is, there was one transfer belt associated with each die set and each transfer belt moved two columns of shells through the conversion press with each column of shells passing through adjacent lanes. Further, when there are four shell lanes, the sheet including tabs also includes four adjacent rows of tabs. In this configuration, the first row of tabs is coupled to the shells in the first shell lane, the second row of tabs is coupled to the shells in the second shell lane, and so forth.

One common configuration for a conversion press included one die shoe supporting a three lane die set. Thus, there were three lanes for filing blanks/shells into can ends during each cycle. Such a conversion press is identified as a "three-out" conversion press. Another common configuration included two die shoes each supporting a two lane, die set. That is, there were two die shoes each supporting a single die set wherein the die set had multiple lanes. With two die sets each having two lanes, the conversion press produced four can ends each cycle. That is, the conversion press was a "four-out" conversion press. This was, for some time, the limit for the number of can ends produced by a conversion press. That is, the "four out" conversion press typically operated at 750 strokes/cycles per minute (750 cycles×4 shell lanes=3000 "shells per minute" (hereinafter, "SPM")).

It is desirable to increase the number of shells processed each minute. One factor limiting the number of blanks/shells processed during each cycle is the characteristics of legacy ram presses. That is, the legacy ram presses lacked the power/strength to form more than four blanks/shells during each cycle and/or the legacy ram presses lacked room to accommodate the components of a conversion press that produced more than four blanks/shells during each cycle.

Improvements to legacy ram presses such as, but not limited to, reducing the weight of various rain press components (or conversion press components) and/or improving the strength of the ram press, now allow a conversion press to produce more than four can ends at a time. That is, there is a "six-out" conversion press. This six-out conversion press, however, also has many problems. For example, the six-out conversion press is limited to 750 cycles per minute resulting in 4,500 SPM. While this is an improvement over a 3000 SPM four-out conversion press, there is still room for further improvement. That is, a conversion press with an output limited to 4,500 SPM is a problem.

Further, the six-out conversion press has other problems. For example, one limitation of a legacy ram press is the space in which the shell lanes can be disposed. As noted above, each shell lane requires space and the most a legacy press accommodated was two die shoes each supporting a two lane die set resulting in the four-out conversion press discussed above. The known "six-out" conversion press utilizes two die shoes each supporting a three lane die set. This configuration, however, is not desirable and the use of two, three lane die sets is a problem. Stated alternately, no known tooling set is structured with three, two lane shell die sets coupled to a legacy ram press. This is a problem.

Further, the elastic nature of the transfer belt naturally allows the transfer belt to deform. A transfer belt having three columns, however, deforms too much. That is, it is known that the wider the transfer belt, the more the belt is prone to deformation. Similarly, the more material removed from the belt (to make the recesses) makes the transfer belt prone to deformation. When the belt deforms, the shells being moved thereby become misaligned with the lane and/or the individual dies in a lane. This results in the shells being deformed. For example, when the shell is misaligned with the dies, the rivet is formed in the wrong location. Such deformed shells must be discarded. As such, a belt with too many columns of recesses is a problem. Similarly, a transfer belt that is too wide is a problem.

Thus, one solution for creating a six-out conversion press is to use three, two lane die sets/two column transfer belts so that each transfer belt is more narrow. As noted above, however, a legacy ram press has limited space and cannot accommodate three, two lane die sets in their current configuration. That is, the current configuration of two lane die sets is a problem in that such die sets cannot be used on a legacy ram press to form a six-out conversion press. Stated alternately, in the known art, elements of a conversion press with a configuration of one die set per die shoe cannot be used to form a six-out conversion press. That is, the die shoes and associated components occupy a sufficient space so that having a six-out conversion press requires the die set to be a three lane die set. This is a problem.

Further, assuming that it was possible to use three, two lane die sets with a legacy ram press, a conversion press in such a configuration still lacks a sufficient speed. That is, the transfer assembly is still limited to moving 4500 SMP. This is also a problem. Stated alternately, the transfer belt assembly for such conversion presses are limited to passing 4500 SPM through the conversion press. There is always a desire to increase the number of can ends a conversion press produces and, as such, the limit of 4500 SPM, as well as transfer belt assemblies limited to this number of shells, is a problem.

Further, a conversion press is subject to changes due to the changing temperature where it is located. Generally, the substantially metal conversion press expands when it is warm and shrinks when it is cold. These changes are detrimental to the positioning/alignment of the conversion press elements and therefore detrimental to the can ends being formed. To reduce the changes in the can ends as the temperature changes, the conversion press includes a number of "kiss blocks." As used herein, a "kiss block" is a metal construct, and in an exemplary embodiment, a hardened steel construct. The kiss blocks are disposed in opposed pairs, i.e., one kiss block on the upper tooling and an opposed kiss block on the lower tooling. When the tooling moves into the second position, the kiss blocks engage each other (or "kiss") just before the forming dies form the shell/tab. In this configuration, the kiss blocks preload the forming dies and resist changes in the vertical position of the dies due to changes in temperature. The kiss blocks were disposed on either lateral side of the lane(s) defined by the die set or within the lanes. For example, in a press with two die sets, there was a number of kiss blocks on each lateral side of each die set. Thus, there were two sets of kiss blocks disposed between the die sets. That is, the kiss blocks were associated with a single die set. Stated alternately, two, or more, die sets did not share kiss blocks. This is a disadvantage as the kiss blocks occupy space on the die shoes that could be used for other purposes. Further, the steel kiss blocks on the upper tooling had to be moved by the ram press. The increased weight due to a large number of kiss blocks is a problem.

Further, when a transfer belt has three columns of recesses, the kiss blocks cannot be positioned an effective distance from the center column of recesses. That is, the kiss blocks should be located immediately adjacent a forming station within a shell lane. When there are only two shell lanes, the positioning of the kiss block adjacent the transfer belt is possible as the kiss blocks are located on either side of the transfer belt path and are therefore immediately adjacent the dies on either side of the shell lane. When a transfer belt has three columns of recesses, however, the kiss blocks cannot be located immediately adjacent the dies in the center lane. That is, if the transfer belt is solid in a location aligned with a kiss block, the kiss blocks do not contact each other (or would compress and damage the transfer belt). Thus, a transfer belt with three columns of recesses is a problem because such a configuration prevents a kiss block from being disposed an effective distance from the score dies associated with the middle column of recesses.

It is noted that an apparent solution to this problem is to cut kiss block passages in the transfer belt. There are, however, other considerations that make such a solution untenable. For example, it is common to use a vacuum system to hold the transfer belt, and the shells, against the lower tooling assembly. If the belt included passages, it is likely that such passages would be aligned with a vacuum passage. In this configuration, a vacuum could not be drawn. Further, as noted above, if the transfer belt includes an opening for the upper tooling kiss block to pass through, the transfer belt has even less material and is more prone to deformation which is a problem.

Another problem associated with a conversion press operating at more than 4500 SPM is that a deformation similar to slack develops in the elastic transfer belt. Generally, it is desirable to limit the number of constructs that contact the transfer belt so as to avoid damage to the transfer belt. Thus, traditionally, conversion presses do not include a construct such as a belt idler for a transfer belt. That is, an idler increases the wear and tear on a transfer belt and increases the complexity of the transfer belt assembly. This is a problem.

Another problem associated with a conversion press operating at more than 4500 SPM is that the elements of the conversion press are either moving faster and/or there are more elements in motion. This is a problem because the faster motion/more elements in motion produce reactive forces that cause wear and tear on other elements of the conversion press. Many of these elements are made from metal such as, but not limited to, steel so as to be durable. This is a problem because steel elements have a greater mass and, as such, cause more wear and tear. As such, it is desirable to reduce the mass of selected elements.

There is, therefore, a need for an improved transfer belt assembly wherein the number of dies/the number of die shoes, are generally balanced/balanced on either side of the ram press line of action. There is a further need for a transfer belt assembly wherein the transfer belts are not easily deformed due to an excess width and/or an excessive number of columns of recesses. There is a further need for a transfer belt assembly that is structured to allow kiss blocks to be positioned an effective distance from the dies. There is a further need for a transfer belt assembly including selected elements with a reduced mass.

SUMMARY OF THE INVENTION

These needs, and others, are met by at least one embodiment of the disclosed and claimed concept provides a transfer belt assembly including a plurality of transfer belts and wherein the plurality of transfer belts are structured to move an increased number of shells. This solves the problem (s) noted above. Further, at least one embodiment of the disclosed and claimed concept provides a conversion press including a plural die shoe. A plural die shoe allows for a plurality of die sets to be coupled to a single die shoe thereby reducing the space required by the tooling assemblies and solving the problem(s) noted above. Further, the conversion press, as described below, solves the problem(s) noted above.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
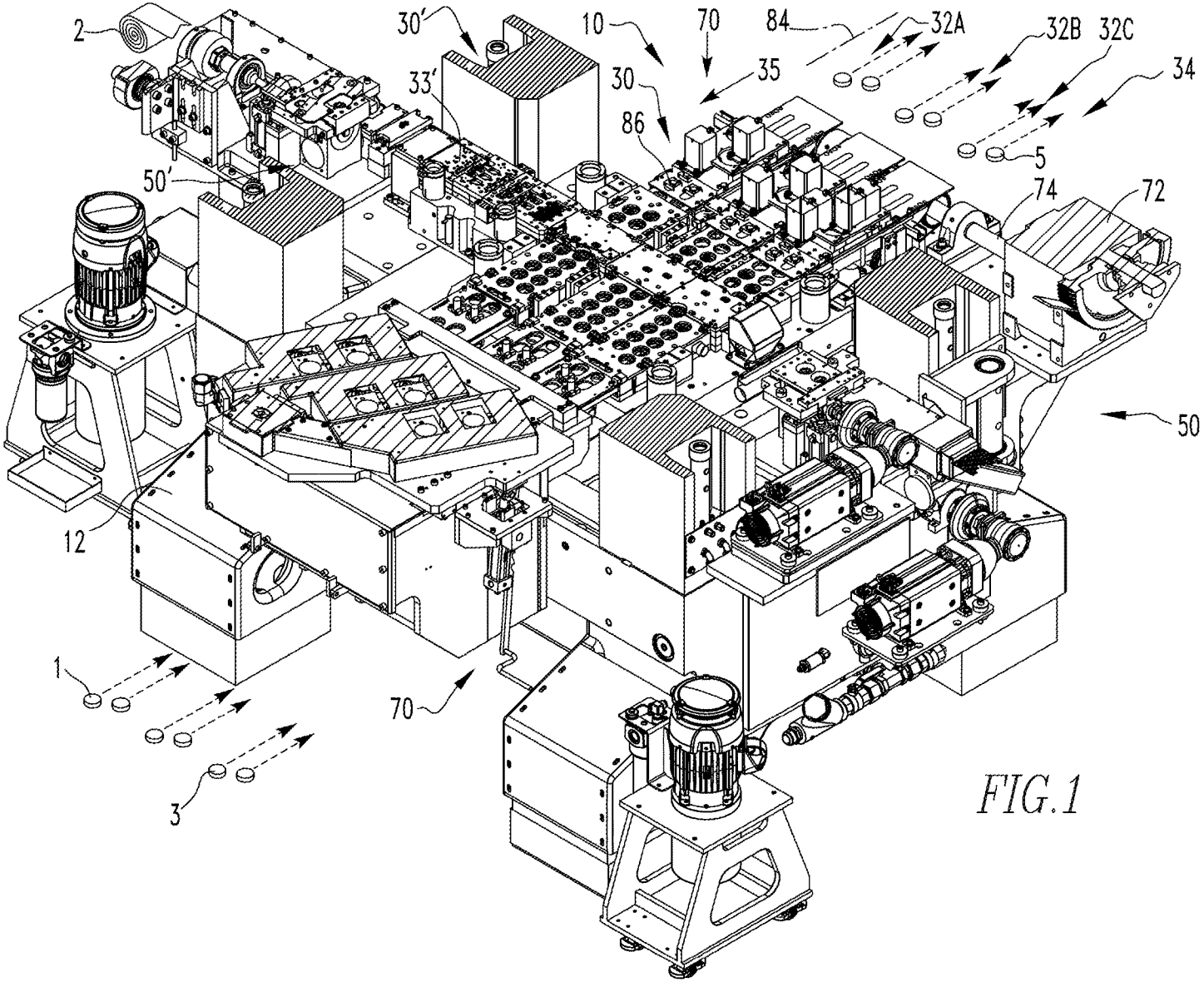
FIG. 1 is a partial isometric view of a conversion press. That is, the ram press, the upper tooling assembly and selected other elements are not shown for clarity.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut or threaded bore. Further, a passage in an element is part of the "coupling" or "coupling component(s)." For example, in an assembly of two wooden boards coupled together by a nut and a bolt extending through passages in both boards, the nut, the bolt and the two passages are each a "coupling" or "coupling component."

As used herein, a "fastener" is a separate component structured to couple two or more elements. Thus, for example, a bolt is a "fastener" but a tongue-and-groove coupling is not a "fastener." That is, the tongue-and-groove elements are part of the elements being coupled and are not a separate component.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. As used herein, "adjustably fixed" means that two components are coupled so as to move as one while maintaining a constant general orientation or position relative to each other while being able to move in a limited range or about a single axis. For example, a doorknob is "adjustably fixed" to a door in that the doorknob is rotatable, but generally the doorknob remains in a single position relative to the door. Further, a cartridge (nib and ink reservoir) in a retractable pen is "adjustably fixed" relative to the housing in that the cartridge moves between a retracted and extended position, but generally maintains its orientation relative to the housing. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, an object resting on another object held in place only by gravity is not "coupled" to the lower object unless the upper object is otherwise maintained substantially in place. That is, for example, a book on a table is not coupled thereto, but a book glued to a table is coupled thereto.

As used herein, the phrase "removably coupled" or "temporarily coupled" means that one component is coupled with another component in an essentially temporary manner. That is, the two components are coupled in such a way that the joining or separation of the components is easy and would not damage the components. For example, two components secured to each other with a limited number of readily accessible fasteners, i.e., fasteners that are not difficult to access, are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein, "functionally coupled" means that a number of elements or assemblies are coupled together so that a characteristic and/or function of one element/assembly is communicated or useable by the other element/assembly. For example, a characteristic of an extension cord is the ability to communicate electricity. When two extension cords are "functionally coupled," the two extension cords are coupled so that electricity is communicable through both extension cords. As another example, two wireless routers, which have the characteristic of communication data, are "functionally coupled" when the two routers are in communication with each other (but not physically coupled to each other) so that data is communicable through both routers.

As used herein, the statement that two or more parts or components "engage" one another means that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A either engages element B while in element A first position.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "temporarily coupled" to the screw. If an axial force is applied to the screwdriver, the screwdriver is pressed against the screw and "engages" the screw. However, when a rotational force is applied to the screwdriver, the screwdriver "operatively engages" the screw and causes the screw to rotate. Further, with electronic components, "operatively engage" means that one component controls another component by a control signal or current.

As used herein, "temporarily disposed" means that a first element(s) or assembly (ies) is resting on a second element (s) or assembly(ies) in a manner that allows the first element/assembly to be moved without having to decouple or otherwise manipulate the first element. For example, a book simply resting on a table, i.e., the book is not glued or fastened to the table, is "temporarily disposed" on the table.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening are made from a deformable or compressible material, the opening may even be slightly smaller than the component being inserted into the opening. With regard to surfaces, shapes, and lines, two, or more, "corresponding" surfaces, shapes, or lines have generally the same size, shape, and contours.

As used herein, a "path of travel" or "path," when used in association with an element that moves, includes the space an element moves through when in motion. As such, any element that moves inherently has a "path of travel" or "path." Further, a "path of travel" or "path" relates to a motion of one identifiable construct as a whole relative to another object. For example, assuming a perfectly smooth road, a rotating wheel (an identifiable construct) on an automobile generally does not move relative to the body (another object) of the automobile. That is, the wheel, as a whole, does not change its position relative to, for example, the adjacent fender. Thus, a rotating wheel does not have a "path of travel" or "path" relative to the body of the automobile. Conversely, the air inlet valve on that wheel (an identifiable construct) does have a "path of travel" or "path" relative to the body of the automobile. That is, while the wheel rotates and is in motion, the air inlet valve, as a whole, moves relative to the body of the automobile.

As used herein, the word "unitary" means a component that is created as a single piece or unit. That is, a component that includes pieces that are created separately and then coupled together as a unit is not a "unitary" component or body.

As used herein, the term "number" shall mean one or an integer greater than one (i.e., a plurality). That is, for example, the phrase "a number of elements" means one element or a plurality of elements. It is specifically noted that the term "a 'number' of [X]" includes a single [X].

As used herein, in the phrase "[x] moves between its first position and second position," or, "[y] is structured to move [x] between its first position and second position," "[x]" is the name of an element or assembly. Further, when [x] is an element or assembly that moves between a number of positions, the pronoun "its" means "[x]," i.e., the named element or assembly that precedes the pronoun "its."

As used herein, a "radial side/surface" for a circular or cylindrical body is a side/surface that extends about, or encircles, the center thereof or a height line passing through the center thereof. As used herein, an "axial side/surface" for a circular or cylindrical body is a side that extends in a plane extending generally perpendicular to a height line passing through the center of the cylinder. That is, generally, for a cylindrical soup can, the "radial side/surface" is the generally circular sidewall and the "axial side(s)/surface(s)" are the top and bottom of the soup can. Further, as used herein, "radially extending" means extending in a radial direction or along a radial line. That is, for example, a "radially extending" line extends from the center of the circle or cylinder toward the radial side/surface. Further, as used herein, "axially extending" means extending in the axial direction or along an axial line. That is, for example, an "axially extending" line extends from the bottom of a cylinder toward the top of the cylinder and substantially parallel to a central longitudinal axis of the cylinder.

As used herein, "generally curvilinear" includes elements having multiple curved portions, combinations of curved portions and planar portions, and a plurality of planar portions or segments disposed at angles relative to each other thereby forming a curve.

As used herein, a "planar body" or "planar member" is a generally thin element including opposed, wide, generally parallel surfaces, i.e., the planar surfaces of the planar member, as well as a thinner edge surface extending between the wide parallel surfaces. That is, as used herein, it is inherent that a "planar" element has two opposed planar surfaces. The perimeter, and therefore the edge surface, may include generally straight portions, e.g., as on a rectangular planar member, or be curved, as on a disk, or have any other shape.

As used herein, for any adjacent ranges that share a limit, e.g., 0%-5% and 5%-10, or, 0.05 inch-0.10 inch and 0.001 inch-0.05 inch, the upper limit of the lower range, i.e., 5% and 0.05 inch in the lower range of the examples above, means slightly less than the identified limit. That is, in the example above, the range 0%-5% means 0%-4.999999° and the range 0.001 inch-0.05 inch means 0.001 inch-0.04999999 inch.

As used herein, "upwardly depending" means an element that extends upwardly and generally perpendicular from another element.

As employed herein, the terms "can" and "container" are used substantially interchangeably to refer to any known or suitable container, which is structured to contain a substance (e.g., without limitation, liquid; food; any other suitable substance), and expressly includes, but is not limited to, beverage cans, such as beer and beverage cans, as well as food cans.

As used herein, a "can body" includes a base and a depending, or upwardly depending, sidewall. The "can body" is unitary. In this configuration, the "can body" defines a generally enclosed space. Thus, the "can body," i.e., the base and sidewall, also include(s) an outer surface and an inner surface. That is, for example, a "can body" includes a sidewall inner surface and a sidewall outer surface.

As used herein, to "form" metal means to change the shape of a metal construct.

As used herein, "about" in a phrase such as "disposed about [an element, point or axis]" or "extend about [an element, point or axis]" or "[X] degrees about an [an element, point or axis]," means encircle, extend around, or measured around. When used in reference to a measurement or in a similar manner, "about" means "approximately," i.e., in an approximate range relevant to the measurement as would be understood by one of ordinary skill in the art.

As used herein, an "elongated" element inherently includes a longitudinal axis and/or longitudinal line extending in the direction of the elongation.

As used herein, "generally" means "in a general manner" relevant to the term being modified as would be understood by one of ordinary skill in the art.

As used herein, "substantially" means "for the most part" relevant to the term being modified as would be understood by one of ordinary skill in the art.

As used herein, "at" means on and/or near relevant to the term being modified as would be understood by one of ordinary skill in the art.

As used herein, a "plural die shoe" means a single die shoe that is structured to be coupled to a multiple lane die set. In an exemplary embodiment, a "plural die shoe" includes a unitary body to which a multiple lane die set is coupled; such a plural die shoe is, as used herein, a "unitary body plural die shoe."

As used herein, and when used in reference to the spacing between kiss blocks and a die set, an "operative distance" means that the kiss blocks are disposed at a location wherein the deformation of the kiss blocks preloads the dies from two different die sets. Stated alternately, the kiss blocks are associated with, and act upon, a plurality of die sets. When kiss blocks are associated with, and act upon, a plurality of die sets the die sets do not each require their own exclusive kiss blocks. Thus, the tooling set, or collectively the die sets, occupy a "reduced area" As used herein, a tooling set/die sets occupying a "reduced area" allows for three, two lane shell die sets to be coupled to a legacy ram press.

As used herein, "a line of action substantially aligned with the longitudinal axis" means that the line of force and the longitudinal axis are substantially co-extensive.

As used herein, a "limited plurality of columns of recesses" means two columns of recesses.

As used herein, a transfer belt having a "deformation resistant width" means a transfer belt with a lateral width of less than 9.0 inches.

As used herein, and when used in reference to the spacing between a column of shell recesses and a kiss block, an "effective distance" means a distance of about 3.5 inches. This "effective distance" is measured from the relevant kiss block to the closest surface of the shell recess closest to the relevant kiss block. That is, as described below, in an exemplary embodiment, there are a plurality of kiss blocks and a number of moving recesses. The "relevant kiss block" is the kiss block to which the "effective distance" is being measured. The "shell recess closest to the relevant kiss block" is the shell recess closest to the relevant kiss block during a given cycle. It is understood that the "shell recess closest to the relevant kiss block during a given cycle" changes during each cycle of the ram press.

As used herein, with respect to a lift gate member, a "reduced mass" means a mass that is less than the mass of a lift gate member with substantially similar dimensions and characteristics made of steel.

As used herein, an "increased number of shells" means between 4506-4799 SPM. As used herein, a "very increased number of shells" means between 4800-5099 SPM. As used herein, an "extremely increased number of shells" means 5100 shells per minute or more.

Figure 2:
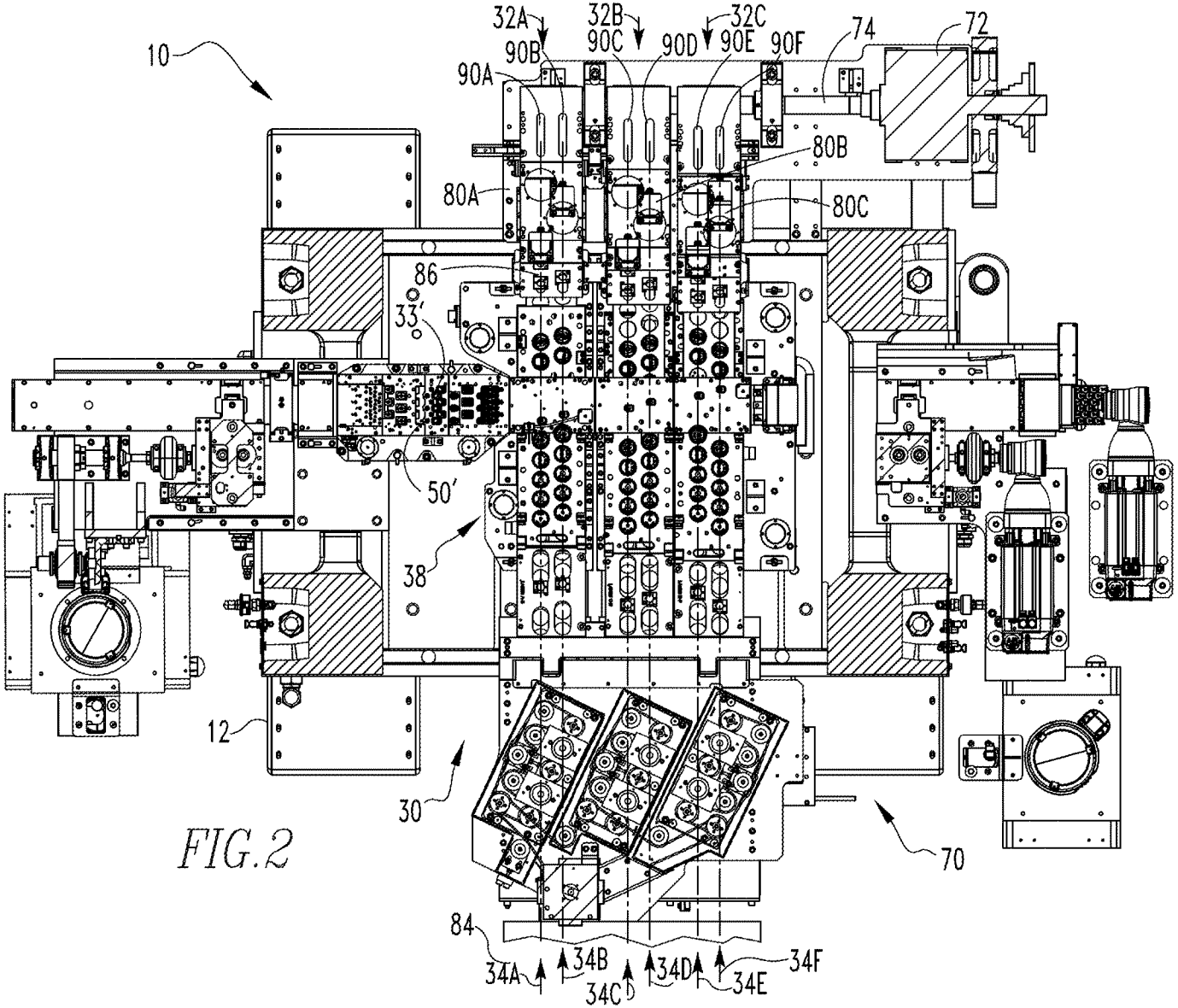
FIG. 2 is a partial top view of a conversion press. That is, the ram press, the upper tooling assembly and selected other elements are not shown for clarity.

As shown in FIGS. 1 and 2, a conversion press 10 is structured to form metal blanks 1 and/or a metal sheet 2 into can ends 5. The following disclosure uses generally circular blanks 1, which are formed into generally circular can ends 5, as an example. It is understood that this shape is exemplary only and the blanks 1/can ends 5 can be of any shape. In an exemplary embodiment, the blanks 1 are initially cut from a sheet of metal such as, but not limited to aluminum, steel, or alloys of aluminum and/or steel. Further, in the exemplary embodiment, the blanks 1 are formed, or partially formed into "shells" 3. As is known, and as used herein, a "shell" means a blank that has certain formations such as, but not limited to, a center panel and a countersink, but which does not include a tab. In the embodiment shown, shells 3 are provided to the conversion press 10. In another embodiment, not shown, the conversion press 10 cuts blanks 1 from a metal sheet 2 and forms the blanks into shells 3. As used herein, when a shell 3 has a tab (not shown) coupled thereto, the shell 3 becomes a "can end" 5.

Figure 3:
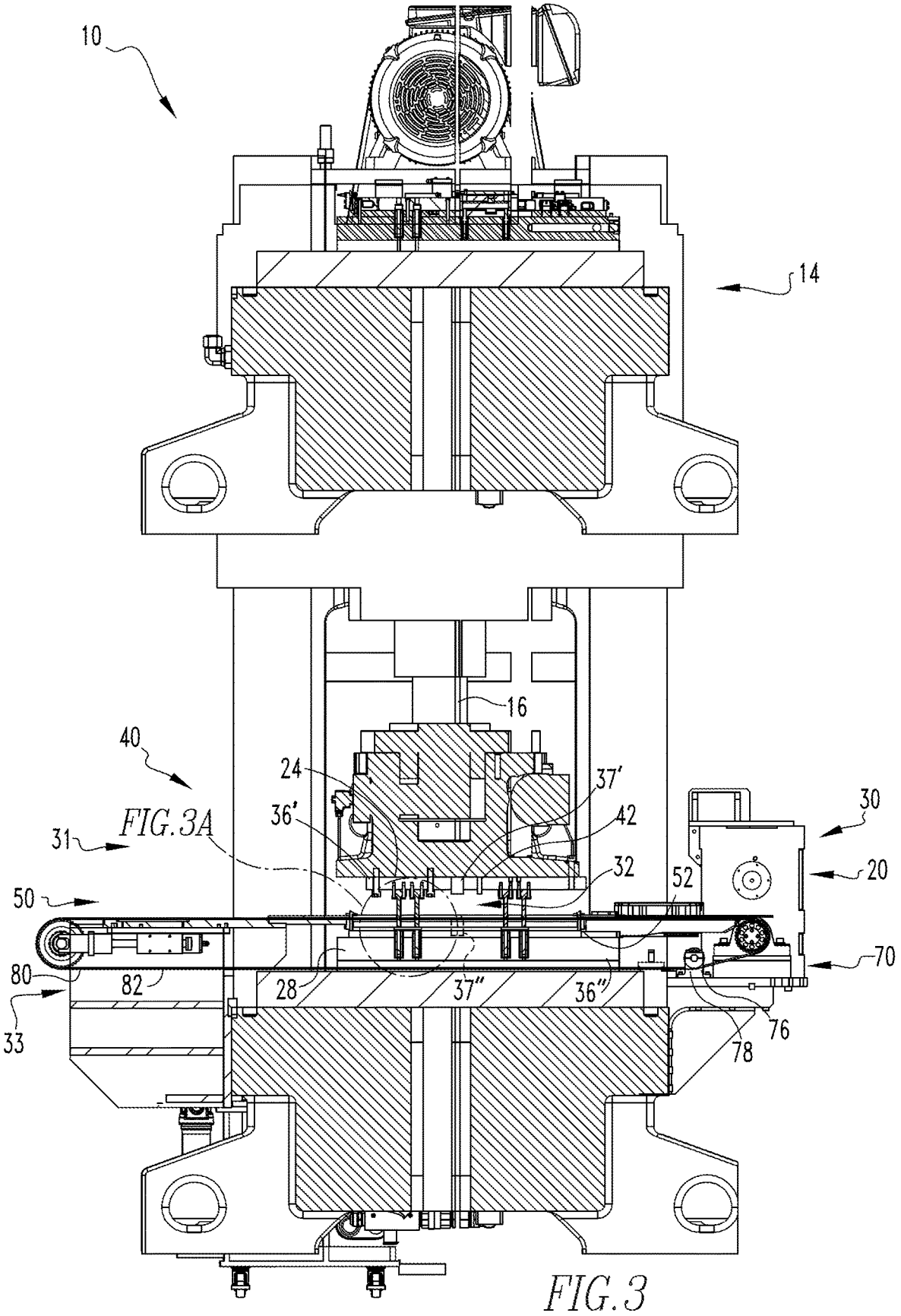
FIG. 3 is a schematic cross-sectional side view of a conversion press.
Figure 3A:
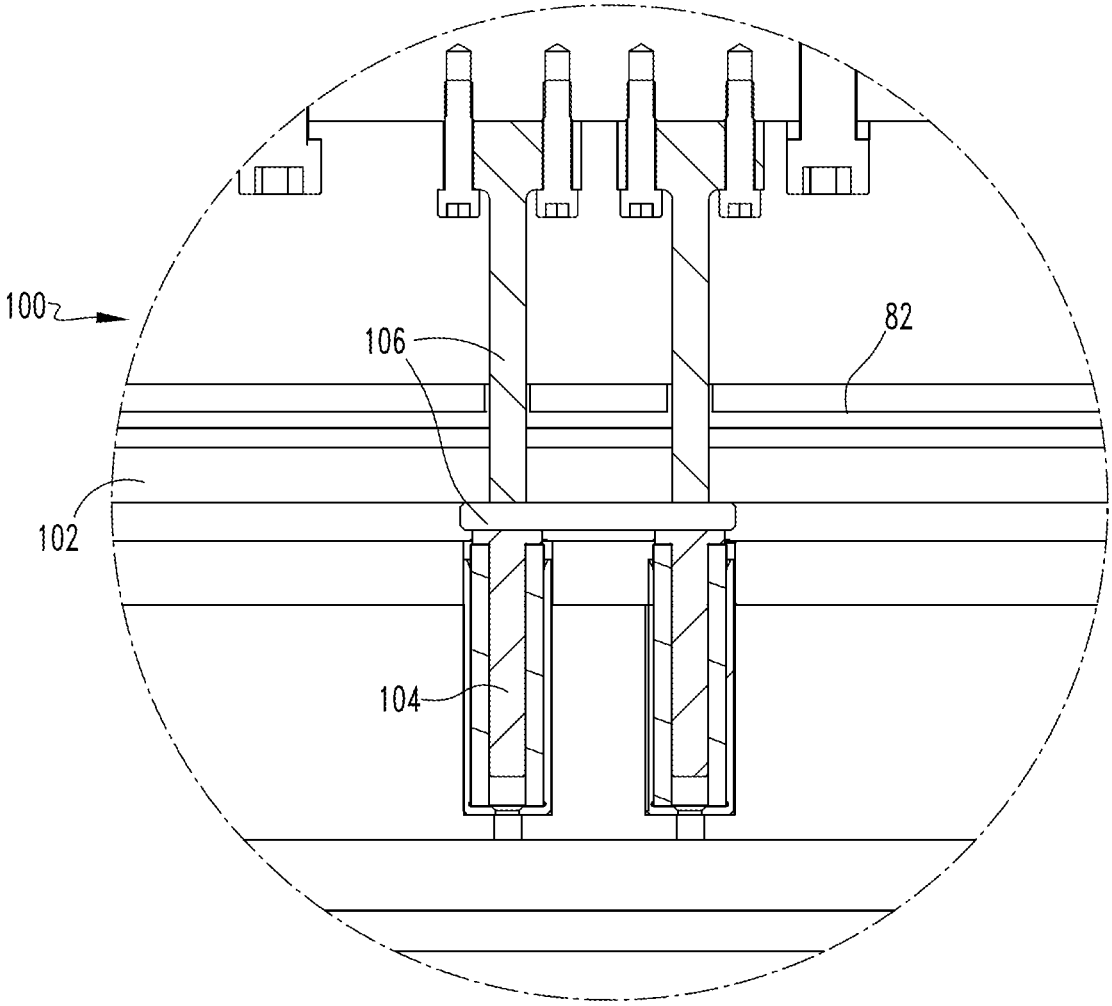
FIG. 3A is a detail view of a lift gate assembly.

The conversion press 10 includes a housing/frame assembly 12 (hereinafter "housing assembly" 12), a ram press 14 (FIG. 3), a tooling set 20, and a transfer belt assembly 70. The housing assembly 12 is structured to, and does, support the other elements of the conversion press 10. Generally, the specific details of the ram press 14 are not relevant to this disclosure other than to note that the ram press 14 is a legacy ram press 14 that includes an elongated ram body 16 (FIG. 3), that is structured to move in a reciprocal motion and to apply a force sufficient to form metal at a plurality of forming stations, as described below. As is known, the ram press 14 applies the force through the ram body 16. Thus, the ram body 16 is structured to, and does, apply a force along a line of action substantially aligned with the longitudinal axis of the ram body 16. Further, the ram body 16 is structured to be, and is, coupled (indirectly in an exemplary embodiment) to a number of tooling assemblies 30 and, in an exemplary embodiment, an upper die assembly 40, as described below. In the exemplary configuration, the ram body 16 is disposed generally above the tooling assemblies 30 and moves the upper die assemblies 40 downwardly into a second position, as described below.

That is, the nomenclature as used herein is as follows: the "tooling set 20" includes a number of upper die shoes 24, a number of lower die shoes 28, and a number of "tooling assemblies 30." That is, the "tool set" means, essentially, all the elements that are, or can be, swapped out on the ram press 14 when the conversion press 10 is configured to form a different type of can end 5. Each "tooling assembly 30" includes an "upper tooling assembly 31" and a "lower tooling assembly 33." In the embodiment disclosed herein, each "upper tooling assembly 31" is movably coupled to the housing assembly 12 and operatively engaged by the ram press 14 and is structured to move between a first position, wherein the "upper tooling assembly 31," and elements coupled thereto, are spaced from an associated "lower tooling assembly 33" and elements coupled thereto, and, a second position, wherein the "upper tooling assembly 31," and elements coupled thereto, are disposed a forming distance from the associated "lower tooling assembly 33" and elements coupled thereto. Further, each "upper tooling assembly 31" includes one of the upper die shoes 24 and an upper die assembly 40. Similarly, each "lower tooling assembly 33" includes one of the lower die shoes 28 and a lower die assembly 50. That is, as used herein, the upper die shoes 24 and the lower die shoes 28 are identified collectively as part of the tooling set 20 and individually as part of an upper tooling assembly 31/lower tooling assembly 33. Further, each upper die assembly 40 has an associated lower die assembly 50, i.e. the upper and lower dies assembly that are disposed in opposition to each other are associated and are also identified collectively herein as a "shell die set 32," as discussed below. In an exemplary embodiment, the tooling set 20, or stated alternately, all the shell die sets 32, occupy a reduced area and are structured to be coupled to a legacy ram press 14. This solves the problem(s) stated above.

In an exemplary embodiment, upper die shoe 24 is coupled, directly coupled, or fixed to the ram press 14/the ram body 16 and moves therewith. Stated alternately, the ram body 16 operatively engages the upper die shoe 24. Each lower die shoe 28 is coupled, directly coupled, or fixed to the housing assembly 12 and is substantially stationary. Each upper die assembly 40 is coupled, directly coupled, or fixed to an upper die shoe 24 and moves therewith. Each lower die assembly 50 is coupled, directly coupled, or fixed to a lower die shoe 28 and is substantially stationary. Thus, the tooling set 20, the tooling assemblies 30, and the die sets 32 (discussed below), are structured to, and do, form the blanks 1/shells 3. In this configuration, the upper die assembly 40 is structured to, and does, move between a first position, wherein the upper die assembly 40 is spaced from an associated lower die assembly 50, and, a second position, wherein the upper die assembly 40 is disposed a forming distance from the associated lower die assembly 50. It is understood that when the upper die assembly 40 is in the second position, the pairs of opposed dies 36', 36" are spaced by a forming distance and that a blank 1 therebetween has a forming operation performed thereon.

The tooling set 20 includes a plurality of shell die sets 32 and a tab die set 35. Each tooling assembly 30 structured to form shells 3 includes a number of shell die sets 32 wherein each shell die set 32 defines at least one elongated shell lane 34. As used herein, a "shell lane" 34 means a plurality of dies 36', 36" (discussed below) disposed in series and through which a blank 1/shell 3 passes and is formed. A shell die set 32, as used herein, is either a "single lane" shell die set 32 meaning that the shell die set 32 defines a single shell lane 32, or, a "multiple lane" shell die set 32 meaning that the shell die set 32 defines a plurality of shell lanes 32. Conversion presses with single lanes and multiple lanes are known.

For example, one known conversion press includes three single lanes. So as to distinguish a three single lane configuration from a triple lane configuration, the following definitions are provided. As used herein, in a "multiple lane" shell die set 32 the lanes are immediately adjacent each other. As used herein, "immediately adjacent" means less than 2.9 inches apart. Thus, for example, in the three single lane conversion press noted above, the all lanes are spaced by more than about 7.45 inches. As these lanes are not "immediately adjacent" each other, such lanes are not part of a "multiple lane" shell die set 32.

As a further example, a well-known four-out conversion press includes four lanes wherein a first pair of lanes (a first lane and a second lane) are spaced by less than 2.7825 inches and a second pair of lanes (a third lane and a fourth lane) are also spaced by less than 2.7825 inches. Further, the first pair of lanes and the second pair of lanes are spaced by more than 7.45 inches. In this configuration, the conversion press has two multiple lane die sets. That is, while the pairs of lanes are separated by more than 2.9 inches, the lanes that form each pair are separated by less than 2.9 inches. Thus, each pair of lanes is part of a "multiple lane" shell die set 32.

Further, as used herein, a "multiple lane" die set can be identified by a specific number of lanes. For example, as used herein, a "two-lane" die set is a shell die set 32 that defines two lanes, a "three lane" die set is a shell die set 32 that defines three shell lanes, etc.

The tooling set 20 also includes one tooling assembly 30 that is structured to, and does, form tabs. This is the tab tooling assembly 30 which includes a tab upper tooling assembly 31 and a tab lower tooling assembly 33 and a tab die set 35. The tab die set 35 includes a tab upper die assembly and tab lower die assembly (neither numbered). While the tab tooling assembly 30 defines multiple tab lanes, the tab tooling assembly 30, i.e., the tab die set 35, does not, as used herein, a "multiple lane" die set. That is, the tem' "multiple lane" as used herein only applies to shell die sets 32. Thus, as used herein, a tab die set 35 cannot be, or disclose, a "multiple lane" die set.

Further to the definition set forth above, as used herein, a "shell die set" 32 includes a plurality of pairs of opposed dies 36', 36", i.e., an upper die 36' and a lower die 36", wherein each pair of dies 36', 36" defines a forming station 38. In an exemplary embodiment, the plurality of pairs of opposed dies 36', 36" are disposed in series and in a substantially straight line. Each forming station 38 performs a number of forming operations on blank 1/shell 3. In an exemplary embodiment, each forming station 38 performs a single forming operation on blank 1/shell 3.

In an exemplary "six-out" conversion press 10, the plurality of shell die sets 32 includes a plurality of multiple lane die sets 32. In the embodiment shown, there are three "two-lane" die sets 32 defining six shell lanes 34. That is, in an exemplary embodiment, there is a first multiple lane shell die set 32A defining a first shell lane 34A and a second shell lane 34B, a second multiple lane shell die set 32B defining a third shell lane 34C, a fourth shell lane 34D, and, a third multiple lane shell die set 32C defining a fifth shell lane 34E, and a sixth shell lane 34F. As noted above, the tooling set 20, or stated alternately, all the shell die sets 32, occupy a reduced area. It is understood that, and as used herein, "all the shell die sets 32" means all the previously identified shell die sets 32. Thus, in this embodiment, the first multiple lane shell die set 32A, the second multiple lane shell die set 32B and the third multiple lane shell die set 32C collectively occupy a reduced area. This solves the problem(s) stated above.

As noted above, each tooling assembly 30 includes an upper tooling assembly 31 and a lower tooling assembly 33. Each upper tooling assembly 31 includes one of the upper die shoes 24 and an upper die assembly 40. Each lower tooling assembly 33 includes one of the lower die shoes 28 and a lower die assembly 50. As is known, each upper die assembly 40 is coupled, directly coupled, fixed, or temporarily coupled to an upper die shoe 24, and, each lower die assembly 50 is coupled, directly coupled, fixed or temporarily coupled to a lower die shoe 28. Further, the dies 36', 36" are coupled, directly coupled, fixed, or temporarily coupled to an upper die shoe 24/a lower die shoe 28, respectively.

The following description addresses a first tooling assembly 30 including a pair of associated "plural die shoes," i.e., a "first" upper die shoe 24 and a "first" lower die shoe 28. It is understood that the term "first" when used in reference to the first tooling assembly 30 and/or first upper die shoe 24 and the first lower die shoe 28 is merely an identifier and does not mean that these dies shoes are located at an upstream location or that these dies shoes are more important or significant than other tooling assemblies and/or die shoes.

In an exemplary embodiment, the tooling set 20 includes a first tooling assembly 30 including a first upper die shoe 24 and a first lower die shoe 28. Each of the first upper die shoe 24 and the first lower die shoe 28 are plural die shoes. This solves the problem(s) noted above. That is, each of the first upper die shoe 24 and the first lower die shoe 28 are structured to, and are, coupled, directly coupled, fixed, or temporarily coupled to a plurality of multiple lane die sets 32. By virtue of the fact that two die shoes are not used to support separate die sets 32, the tooling assembly 30 occupies less space and allows for die sets 32 defining six lanes to be coupled to a legacy ram press 14 thereby solving the problem(s) noted above.

As shown, the first multiple lane shell die set upper dies 36' and the second multiple lane shell die set upper dies 36 are coupled, directly coupled, fixed, or temporarily coupled to the first upper die shoe 24. Similarly, the first multiple lane shell die set lower dies 36 and the second multiple lane shell die set lower dies 36 are coupled, directly coupled, fixed, or temporarily coupled to the first lower die shoe 28.

In an exemplary embodiment, the tooling set 20 includes only two tooling assemblies 30 and two pairs of upper/lower die shoes 24, 28 as well as a pair of tab lane dies shoes 24, 28. That is, the tooling set 20 includes first tooling assembly 30 as described above, and a second tooling assembly 30 including a second upper die shoe 24 and a second lower die shoe 28. Thus, in an exemplary embodiment, the first upper/lower die shoes 24/28 are coupled to the first multiple lane shell die set 32A, the second upper/lower die shoes 24/28 are coupled to the second multiple lane shell die set 32B and the third multiple lane shell die set 32C, and the tab upper/lower die shoes 24/28 is coupled to the tab die set 35. In this configuration, the first upper/lower die shoes 24/28 support, or include, the first shell lane 34A and the second shell lane 34B. Further, the second upper/lower die shoes 24/28 support, or include, the third shell lane 34C, the fourth shell lane 34D, the fifth shell lane 34E and the sixth shell lane 34F. The tab upper/lower die shoes 24/28 supports, or includes, the tab die set 35. As noted above, it is understood that when a die set 32 is coupled to upper/lower die shoes 24/28, the upper dies 36' are coupled, directly coupled, fixed or temporarily coupled to the upper die shoe 24 and the lower dies 36" are coupled, directly coupled, fixed or temporarily coupled to the lower die shoe 28.

The tooling assemblies 30 also include a plurality of kiss blocks 42, 52. That is, each upper/lower tooling assembly 31, 33, each die set 32, and/or each upper die assembly 40 and each lower die assembly 50, includes a number of upper kiss blocks 42 and a number of lower kiss blocks 52. As detailed above, kiss blocks 42, 52 operate in conjunction with each other. As such, it is understood that each upper kiss block 42 is associated with a lower kiss block 52. That is, as used herein, the associated kiss blocks 42, 52 are identified as a "pair of kiss blocks" 42, 52. Further, as used herein, every upper kiss block 42 has an associated lower kiss block 52. Thus, the introduction of any kiss block 42, 52 inherently introduces the associated kiss block 42, 52 as well as the "pair of kiss blocks" 42, 52 defined by the associated kiss block 42, 52.

The kiss blocks 42, 52 are disposed adjacent selected dies 36', 36". When the upper die assembly 40 is in the second position, the upper kiss block 42 engages the lower kiss block 52 and both are deformed. As the kiss blocks 42, 52 deform, the kiss blocks 42, 52 operatively engage the adjacent dies 36', 36" and position the dies 36', 36" in a desired location, as is known in the art. In an exemplary embodiment, the kiss blocks 42, 52 are disposed an effective distance from a number of score dies 37', 37". As is known, a score die 37', 37" is a die 36 that forms a score in the blank 1.

The kiss blocks 42, 52 are disposed both an "operative distance" between die sets 32 and an "effective distance" from a column of shell recesses 90, as described below. With regard to the operative distance aspect, the kiss blocks 42, 52 are disposed adjacent to separate die sets 32. The kiss blocks 42, 52 are disposed adjacent, and an operative distance from, at least two die sets 32. As shown, the kiss blocks 42, 52 are disposed adjacent, and an operative distance from, the first multiple lane shell die set 32A and the second multiple lane shell die set 32B. In this position, the kiss blocks 42, 52 preload dies 36 in both the first multiple lane shell die set 32A and the second multiple lane shell die set 32B. Thus, the first multiple lane shell die set 32A and the second multiple lane shell die set 32B do not each require separate kiss blocks 42, 52. Thus, each die set 32 occupies less space and allows a legacy ram press 14 to accommodate six shell lanes 34 thereby solving the problem(s) noted above.

The transfer belt assembly 70 is structured to, and does, move a plurality of blanks 1/shells 3 through the tooling set 20/the tooling assemblies 30. That is, the transfer belt assembly 70 is structured to, and does, move a plurality of shells between each upper tooling assembly 31 and a lower tooling assembly 33. The transfer belt assembly 70 includes an indexing drive assembly 72 and a number of transfer belts 80. The indexing drive assembly 72 includes an output shaft 74 that is operatively coupled to each transfer belt 80. In an exemplary embodiment, all transfer belts 80 are driven by a single indexing drive assembly 72. As noted above, an "indexing" motion means that indexing drive assembly 72 rotates the output shaft 74, and therefore moves the transfer belts 80, a predetermined/set distance during each cycle of the ram press 14/tooling assembly 30. That is, generally, the indexing drive assembly 72 rotates the output shaft 74 and the transfer belts 80 move. In an exemplary embodiment, the operation of the indexing drive assembly 72 and the motion of the transfer belts 80 is limited to the time when the upper die assembly 40 is moving from the second position to the first position. That is, the transfer belts 80 move as the upper die assembly 40 is moving away from the lower die assembly 50. In another exemplary embodiment, operation of the indexing drive assembly 72 and the motion of the transfer belts 80 occurs during the initial motion of the upper die assembly 40 from the first position toward the second position. In all embodiments, the operation of the indexing drive assembly 72 and the motion of the transfer belts 80 stops before, and during, the time the upper die assembly 40 is in the second position. Thus, the blanks 1/shells 3 are not moving during forming operations.

In an exemplary embodiment, there are three transfer belts 80; a lateral, first transfer belt 80A, a central, second transfer belt 80B and a lateral, third transfer belt 80C, as discussed below. The transfer belts 80 are substantially similar and a generic transfer belt 80 is described immediately below. The transfer belt 80 includes an elongated body 82 with ends (not numbered) that are coupled, directly coupled, or fixed to each other so that the transfer belt body 82 forms an elongated loop. That is, the transfer belt body 82, even when formed into a loop, has a centerline or longitudinal axis 84 (hereinafter, "longitudinal axis" 84). In an exemplary embodiment, each transfer belt 80, i.e., each transfer belt body 82, is made from a resilient material such as, but not limited to, neoprene rubber. The transfer belt body 82 includes a plurality of recesses 86. Each transfer belt body recess is sized and shaped to correspond to the blanks 1/shells 3. That is, one shell 3/blank 1 fits within each recess 86. The recesses 86 are disposed in a number columns 90 that extends generally parallel to the transfer belt body longitudinal axis 84. Hereinafter, and as used herein, the collective term "column[s] of recesses 90" means the "column" and the proper reference number to follow the term "recess" is "90" rather than "86." That is, reference number "86" identifies an individual recess 86 whereas reference number "90" identifies a column of recesses 90.

In an exemplary embodiment, each transfer belt 80 includes a limited number of columns of recesses 90. That is, each transfer belt 80 includes two columns of recesses 90 with each column of recesses 90 disposed on opposed sides of the transfer belt body longitudinal axis 84. Further, each transfer belt 80, i.e., each transfer belt body 82, has a deformation resistant width. A transfer belt 80 with a deformation resistant width solves the problem(s) noted above. Further, a transfer belt 80 with two columns of recesses 90 is structured to, and does, allow the spacing between a column of shell recesses 90 and a kiss block 42, 52 to be an "effective distance," as defined above. A transfer belt 80 in this configuration solves the problem(s) noted above. That is, a transfer belt 80 in this configuration allows a kiss block 42, 52 to be an "effective distance" from a selected dies 36', 36".

Further, the transfer belt assembly 70 includes a number of transfer belt idlers 76. That is, there is a first transfer belt idler 76, a second transfer belt idler 76, and a third transfer belt idler 76. As noted above, the art teaches away from an idler for a transfer belt 80. The disclosed and claimed embodiment, however, operates a speed sufficient to require an idler 76 for each transfer belt 80. That is, transfer belt idlers 76 structured to allow a transfer belt assembly 70 to move any of an increased number of shells 3, a very increased number of shells 3, or an extremely increased number of shells 3 through a conversion press 10 are, as used herein, "high speed belt idlers." The transfer belt idlers 76 are high speed belt idlers.

In an exemplary embodiment, each transfer belt idler 76 includes a roller 78 that is rotatably coupled to the housing assembly 12. Each transfer belt idler 76 is disposed adjacent the lower tooling assembly 50 and is structured to, and does, draw the associated transfer belt 80 taught.

While a transfer belt assembly 70 includes any number of transfer belts 80, in an exemplary embodiment, as noted above the transfer belt assembly 70 includes three transfer belts 80; a lateral, first transfer belt 80A, a central, second transfer belt 80B and a lateral, third transfer belt 80C. That is, the transfer belts 80 are disposed on the housing assembly 12 with their longitudinal axes 84 extending generally parallel to each other and with their upper, outer surface disposed in the generally the same plane. Further, in an exemplary embodiment, the ends of the transfer belt loops are generally aligned. That is, other than being laterally offset from each other, the transfer belts 80 are not otherwise offset from each other. In this configuration, when one transfer belt 80 is disposed between the other two, this transfer belt 80 is the central, second transfer belt 80B. Thus, as described above, there is a lateral, first transfer belt 80A disposed to one side of the central, second transfer belt 80B and the lateral, third transfer belt 80C is disposed on the other side of the central; second transfer belt 80B.

Further, as noted above, each transfer belt 80 includes a limited number of columns of recesses 90. That is, the first transfer belt 80A defines a first column of shell recesses 90A and second column of shell recesses 90B the second transfer belt 80B defines a third column of shell recesses 90C and fourth column of shell recesses 90D, and the third transfer belt 80C defines a fifth column of shell recesses 90E and sixth column of shell recesses 90F. Further, each transfer belt 80A, 80B, 80C is structured to, and does, move between an associated shell die set 32A, 32B, 32C. That is, as shown, the first transfer belt 80A moves between the first shell die set 32A; thus, the first column of shell recesses 90A moves through the first shell lane 34A and the second column of shell recesses 90B moves through the second shell lane 34B. Similarly, the second transfer belt 80B moves between the second shell die set 32B; thus, the third column of shell recesses 90C moves through the third shell lane 34C and the fourth column of shell recesses 90D moves through the fourth shell lane 34D. Finally, the third transfer belt 80C moves between the third shell die set 32C; thus, the fifth column of shell recesses 90E moves through the fifth shell lane 34E and the sixth column of shell recesses 90F moves through the sixth shell lane 34F. In this configuration, each cycle of the conversion press 10 produces six can ends. That is, the conversion press 10 is a "six-out" conversion press 10.

Further, the conversion press 10 is structured to, and does, process any of an increased number of shells 3, a very increased number of shells 3, or an extremely increased number of shells 3. This solves the problem(s) noted above. Further, as the shells 3 processed by the conversion press 10 are moved by the transfer belt assembly 70, the transfer belt assembly 70 is structured to move any of an increased number of shells 3, a very increased number of shells 3, or an extremely increased number of shells 3 through the conversion press 10. As discussed below, in an exemplary embodiment, the transfer belt assembly 70 includes a plurality of transfer belts 80. Thus, stated alternately, the plurality of transfer belts are structured to move an increased number of shells, a very increased number of shells 3, or an extremely increased number of shells 3. This solves the problem(s) noted above.

As also noted above, however, increasing the number of shells 3 processed per minute creates problems with the additional/increased forces associated with such faster processing. To address a selected number of the additional/increased forces associated with such faster processing, the transfer belt assembly 70 includes a limited number of columns of recesses 90. This solves the problem(s) noted above.

Further, to address problems associated with additional/increased forces and faster processing, the transfer belt assembly 70 includes a lift gate assembly 100 wherein a lift gate member 102 has a reduced mass. That is, the lift gate assembly 100 includes an elongated lift gate member 102, a lifting assembly 104 and an actuator assembly 106. The lift gate member 102 is, generally, a planar member with a series of recesses (neither numbered). The lift gate member recesses are slightly larger than the shells 3 and/or the transfer belt recess 86. Each lift gate member 102 is disposed in a shell lane 34. The lifting assembly 104 is structured to, and does, move the lift gate member 102 between an upper, first position, wherein the lift gate member 102 is spaced from the lower die assembly 50, and a lower, second position, wherein the lift gate member 102 is spaced from the lower die assembly 50. In an exemplary embodiment, the lifting assembly 104 includes springs that bias the lift gate member 102 to the first position. The actuator assembly 106 is structured to, and does, actuate the lifting assembly 104. In an exemplary embodiment, the actuator assembly 106 includes downwardly depending rods (not numbered) extending from the upper die assembly 40. In this embodiment, the actuator assembly 104 contacts the lift gate member 102 as the upper die assembly 40 moves toward the second position and overcomes the bias of the lifting assembly 104 and causes the lifting assembly 104 to move the lift gate member 102 to the second position.

When the conversion press 10 processes any of an increased number of shells 3, a very increased number of shells 3, or an extremely increased number of shells 3, and if the lift gate assembly 100 is too heavy, the reciprocal motion of the lift gate assembly 100 is undesirable. As such, and in an exemplary embodiment, the lift gate assembly 100 includes a lift gate member 102 having a reduced mass. As used herein, a "reduced mass" means a construct with a density of about 0.065 lb/in.$^3$ A lift gate member 102 with such a density and/or made from a composite material solves the problem(s) noted above.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof

What is claimed is:

1. A conversion press comprising: a housing assembly: a ram press coupled to said housing assembly and including an elongated ram body structured to reciprocate and apply a force along a line of action substantially aligned with the longitudinal axis of the ram body; a plurality of die sets each defining an elongated shell lane: a lower die assembly coupled to said housing assembly and an upper die assembly operatively engaged by said ram press; and a transfer belt assembly consisting of three transfer belts, each said transfer belt movably disposed between the upper die assembly and the lower die assembly, wherein each transfer belt includes two columns of shell recesses, and wherein each transfer belt has a deformation resistant width, wherein each die set includes a number of kiss blocks and a number of score dies: wherein at least one kiss block is disposed adjacent each score die: and wherein each column of shell recesses is disposed an effectual distance from a corresponding kiss block.

2. The conversion press of claim 1 wherein:

said three transfer belts is a lateral, first transfer belt, a central, second transfer belt and a lateral, third transfer belt.

3. The conversion press of claim 1 wherein:

said transfer belt assembly includes a number of transfer belt idlers;

wherein each transfer belt idler is associated with a single transfer belt in said transfer belt assembly plurality of transfer belts; and wherein each transfer belt idler is a high speed belt idler.

4. The conversion press of claim 1 wherein:

said transfer belt assembly includes a lift gate assembly;

said lift gate assembly including an elongated lift gate member, a lifting assembly and an actuator assembly; and said lift gate member having a reduced mass.

5. The conversion press of claim 1 wherein the die sets occupy a reduced area.

* * * * *